United States Patent [19]

Pasbrig

[11] 4,172,439

[45] Oct. 30, 1979

[54] BREAK IGNITION PLUG

[75] Inventor: Max Pasbrig, Orselina, Switzerland

[73] Assignee: Lacrex Brevetti, S.A., Minusio, Switzerland

[21] Appl. No.: 837,728

[22] Filed: Sep. 29, 1977

[30] Foreign Application Priority Data

Nov. 23, 1976 [DE] Fed. Rep. of Germany ..... 2653226

[51] Int. Cl.[2] ..... F02P 23/00

[52] U.S. Cl. ..... 123/148 E; 123/143 R

[58] Field of Search ..... 123/147, 169 EL, 143 A, 123/143 B, 146.5 R, 164 EB, 153, 143 R; 335/255; 313/125, 129, 126, 152

[56] References Cited

U.S. PATENT DOCUMENTS

| | | | |
|---|---|---|---|
| 1,041,477 | 10/1912 | Honold | 123/147 |
| 1,429,821 | 9/1922 | Abbott | 313/126 |
| 2,347,072 | 4/1944 | Beeh | 123/147 |
| 2,951,133 | 8/1960 | Davies et al. | 335/255 |
| 2,972,077 | 2/1961 | Chapman | 313/126 |
| 3,139,496 | 6/1964 | Beller et al. | 335/255 |
| 3,693,607 | 9/1972 | Pasbrig | 123/169 EL |
| 3,882,338 | 5/1975 | Meyer | 313/126 |
| 3,908,146 | 9/1975 | Pasbrig | 123/146.5 A |

*Primary Examiner*—Charles J. Myhre
*Assistant Examiner*—R. A. Nelli
*Attorney, Agent, or Firm*—Werner W. Kleeman

[57] ABSTRACT

A break ignition plug for piston engines wherein an electromagnet acts upon an armature which actuates a movable electrode and an ignition pulse flows through a magnet coil of the electromagnet and a short-circuit path between the movable electrode and a counterelectrode (ground electrode). The magnetic field which builds-up in the electromagnet causes breaking of the short-circuit path while forming a spark. A pressure equalization chamber communicates with an internal cylinder chamber of the piston engine for relieving the forces which are to be generated by the armature for the movement of the movable electrode. The armature which is to be attracted, against the force of a spring, by the electromagnet is located at least partially at the side of the electromagnet confronting the inner cylinder chamber and carries the movable electrode directed towards the inner cylinder compartment. The movable electrode protrudes with its contact tip into a floor or bottom portion of the ignition plug housing where there is fixedly mounted the counterelectrode, the bottom portion opening into the inner cylinder compartment.

19 Claims, 4 Drawing Figures

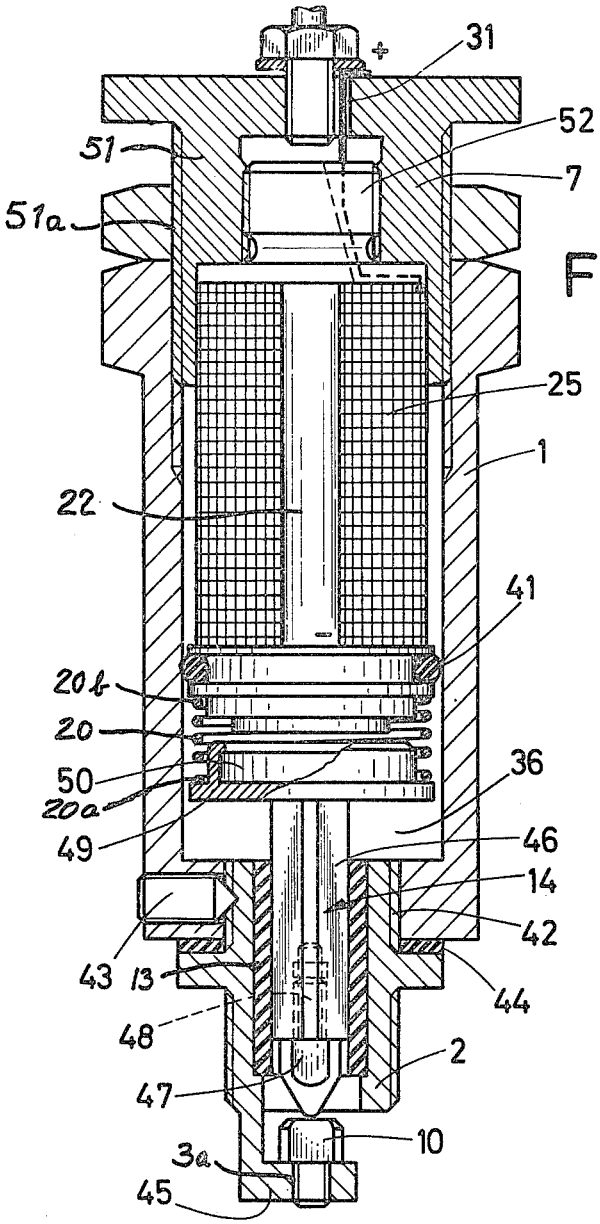
Fig. 2
Fig. 3a
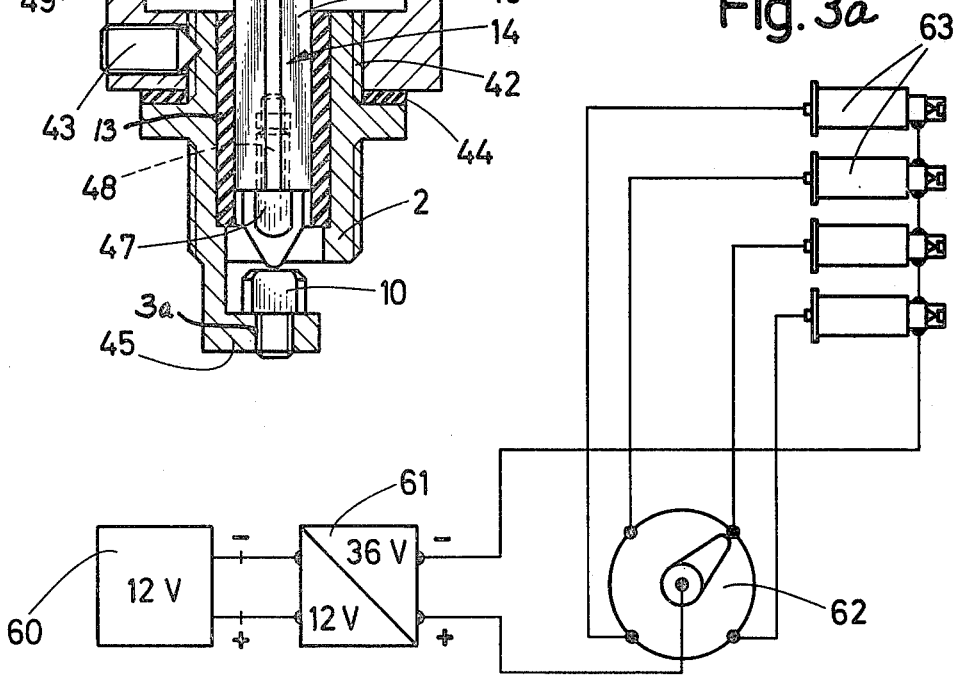

BREAK IGNITION PLUG

BACKGROUND OF THE INVENTION

The present invention relates to a new and improved construction of make-and-break ignition plug—hereinafter simply referred to as break ignition plug—for piston engines which is of the type wherein an electromagnet acts upon an armature which actuates a movable electrode and an ignition pulse flows through the magnet coil of the electromagnet and a short-circuit path between the movable electrode and a counterelectrode (ground electrode), the magnetic field which builds-up in the electromagnet causing breaking of the short-circuit path in the presence of spark formation, there further being provided a pressure equalization chamber which communicates with an internal cylinder compartment of the piston motor or internal combustion engine in order to relieve the forces which are to be applied by the armature for the movement of the movable electrode.

Although break ignition plugs generate powerful ignition sparks at relatively low voltages, they have not found wide spread acceptance in practice. Apart from a pronounced burning-off of the electrodes, a freezing together of the interrupter contacts, sooting and similar disturbances, furthermore, the high and periodically alternating internal pressure of the cylinder causes considerable difficulties. In particular, the movable electrode must be shifted away by means of the armature from the stationary electrode in rapid time sequences, corresponding to the rotational speed of the piston motor or engine. This break movement is accomplished with the prior art break ignition plugs against the compression pressure, so that the armature and the magnet coil must be capable of applying relatively large forces. According to a state-of-the-art break ignition plug, as taught in German Pat. No. 1,919,828, the difficulties which are predicated upon the internal pressure of the cylinder are extensively overcome due to the construction of a pressure equalization chamber over the magnet coil. The pressurized gas which flows out of the internal compartment of the cylinder into the pressure equalization chamber thus reduces the forces which are to be applied by the armature, because such essentially only must still apply the mass force for propelling away the movable electrode, but otherwise need not overcome any additional pressure forces. Due to the ascent of the pressure gas into the upper region of the ignition plug past the magnet coil, the upper portion of the ignition plug however tends to heat up rather intensively, the pressure equalization chamber is located at a relatively large distance from the internal compartment of the cylinder and the gases must flow through large bores before they are effective.

SUMMARY OF THE INVENTION

Hence, it is a primary object of the present invention to provide an improved break ignition plug which is not associated with the aforementioned drawbacks and limitations of the prior art constructions.

Still a further significant object of this invention aims at overcoming these drawbacks and providing a simpler and improved construction of break ignition plug which especially overcomes the effects of the compression pressure.

Now in order to implement these and still further objects of the invention, which will become more readily apparent as the description proceeds, the break ignition plug of the previously mentioned type and constructed according to the invention, is manifested by the features that the armature which can be attracted, against the force of a spring, by the electromagnet is at least partially located at the side or end of the electromagnet confronting the inner compartment of the cylinder and carries the movable electrode extending in the direction of such inner compartment of the cylinder. This movable electrode protrudes with its contact tip into a bottom or floor portion of the ignition plug housing where there is fixedly mounted the counterelectrode, the bottom portion being open in the direction of the inner compartment of the cylinder.

According to one constructional manifestation of ignition plug the armature is located totally externally of the electromagnet at the aforementioned side thereof, whereas another embodiment has part of the armature extending into and guided by the electromagnet.

With the inventive break ignition plug the break movement of the electrode and the armature is accomplished in the direction of the pressure propagation of the compression gas. This pressure acts in any case upon the contact tip of the electrode and augments the breaking movement of the electrode. The ignition plug is additionally quite simple and advantageous in its structure. The complete hollow compartment of the housing can be employed for the electromagnet having a powerful magnetic field and a large armature. The individual components can be favorably mounted and also exchanged. In particular the counterelectrode is easily accessible and exchangeable.

The breaking movement of the electrode can be even further augmented if there is provided a pressure equalization chamber between the armature surface at the side of the electrode and the housing. In order to communicate the pressure equalization chamber with the interior of the cylinder the electrode is provided at the periphery of its shaft with at least one, preferably with three uniformly distributed bevelled or flattened portions. With these measures the electrode is also then radially uniformly pressure impinged and guided. If the armature is not sealed with respect to the housing, so that the pressure equalization chamber extends to the electromagnet and also encloses the armature rear surface, then by appropriate configuration of the armature, the pressure surface-conditions and thus the influence upon the movement of the movable electrode can be accommodated to one another as desired.

BRIEF DESCRIPTION OF THE DRAWINGS

The invention will be better understood and objects other than those set forth above, will become apparent when consideration is given to the following detailed description thereof. Such description makes reference to the annexed drawings wherein generally throughout the various embodiments the same reference characters have been employed for the same or analogous components and wherein:

FIG. 2 is a similar sectional view through a somewhat modified embodiment of break ignition plug;

FIG. 3*a* is a schematic circuit diagram of an ignition system or installation equipped with break ignition plugs constructed according to the invention.

DETAILED DESCRIPTION OF THE PREFERRED EMBODIMENTS

Figure 1:
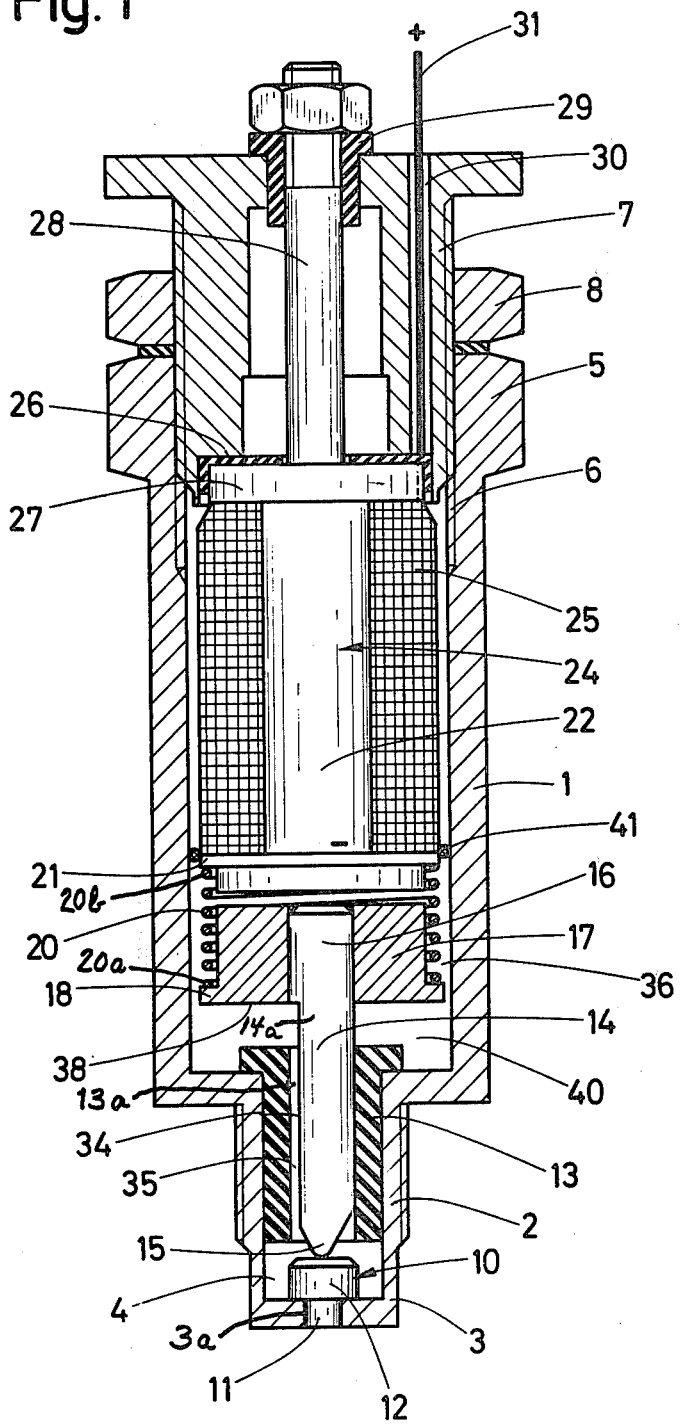
FIG. 1 is a vertical sectional view through a first exemplary embodiment of break ignition plug constructed according to the present invention.

Describing now the drawings, the exemplary embodiment of break ignition plug shown in FIG. 1 will be seen to comprise a cylindrical housing 1 formed of a non-magnetizable material and which is stepped at its lower portion into a threaded part 2 which is threaded into a cylinder head (not shown) of an internal combustion engine or piston motor. This lower threaded part 2 is closed by a bottom portion or floor basket 3 having lateral openings 4. At the upper end of the cylinder housing 1 there is formed a multi-edge nut member 5. Internally of the nut member 5 there is machined threading 6 into which there is threaded a magnet coil holder 7 which can be positionally secured by a counter nut member 8. In the floor portion or bottom portion 3 there is mounted a stationary or fixed counterelectrode 10 which is advantageously exchangeable. To this end, an electrode head 11 is inserted by means of a pin 12 into a suitably formed bore 3*a* of the floor basket or cage 3. The threaded portion or part 2 is lined with an insulating sleeve or bushing 13 serving as guide means for a movable electrode 14.

Continuing, this movable electrode 14 possesses a contact tip 15. At its upper end 16 it is inserted into a plate- or disc-shaped armature 17. At the side of the electrode 14 it is widened in the form of an annular or ring-shaped shoulder 18. Upon the shoulder 18 there is seated one end 20*a* of a compression or pressure spring 20, whereas the other end 20*b* thereof bears against an end plate 21 of an iron core 22 of an electromagnet 24. The magnet coil is designated by reference character 25. Between this magnetic coil 25 and the housing 1 there is present a small amount of play so that the electromagnet 24 can be easily removed and inserted. Additionally, the electromagnet 24 is engaged at an upper end plate 27 thereof, while interposing insulation 26, by the magent holder 7. In the magnet holder 7 there is seated a ground connection bolt 28 which is connected with the electromagnet 24. Bolt 28 is insulated by means of an insulating sleeve or bushing 29 with respect to the magnet holder 7. A bore 30 in the magnet holder 7 serves for the reception of an ignition or firing cable 31 or equivalent structure.

The shaft 14*a* of the illustrated movable electrode 14 possesses at least one peripheral flattened or bevelled portion 34 which extends over the entire length thereof and forms a passageway 35 between it and bushing 13 which leads to an armature chamber 36. The spacing of the bevelled surface or portion 34 with regard to the inner wall of the bore 13*a* of the insulation bushing or sleeve 13 amounts to approximately 1 millimeter. It is advantageous to provide three or more of such uniformly distributed bevelled portions or surfaces 34 at the shaft 14*a*, in order to thereby prevent the electrode 14 from being laterally shifted out of its position by the compression pressure. Since the bevelled portions 34 reduce the friction surfaces they also contribute to facilitate the movement of the electrode 14. By means of the passageways 35 formed by the bevelled portions 34 the compression pressure can propagate into the armature chamber 36. If the ring-shaped shoulder 18 of the armature 17 is sealed in any suitable and therefore not particularly illustrated manner with respect to the housing 1 e.g. by a sealing ring which may be like sealing ring 41 then there is formed between armature-end face or surface 38 and the housing 1 a pressure equalization chamber or compartment 40 and the armature 17 is pressure impinged at its entire end surface 38 in the direction of the electromagnet 24. If there is proved a seal 41 only at the lower end of the magnet coil 25, then the entire armature chamber 36 forms to both sides of the armature 17 the pressure equalization chamber 40. Depending upon the construction of the size of the armature-end surfaces it is then possible to regulate, as desired, the pressures which augment the electrode movement. Thus, under certain circumstances, there also can be obtained a floating state of the armature 17 which imparts quick reaction capabilities thereto. For further protection of the coil winding 25 against thermal effects and combustion gases there also can be inserted an asbestos jacket between the coil 25 and the housing 1.

With the modified construction of ignition plug as shown in FIG. 2 the threaded portion or part 2 is separate from the actual housing 1 and thus detachably connected by means of threading 42. A set screw 43 secures such threaded connection. For sealing purposes there is provided an asbestos insert 44. Also the bracket-shaped floor basket or bottom portion 3 of the embodiment of FIG. 1 is simplified inasmuch as here it is simply formed by a support bracket or angle member 45. The movable electrode 14 comprises a steel shaft 46 and an electrode tip 47 which is detachably threadably connected by means of a threaded bolt 48 or the like with the shaft 46. This construction results in a saving in the high-grade material of the electrode as well as affording the possibility of exchanging the electrode tip 47. Also, while not here particularly shown to simplify the illustration of FIG. 2, the electrode shaft 46 also can be provided with flattened or bevelled portions, like the bevelled portions 34 previously considered with regard to the embodiment of FIG. 1. The armature 17 and its base portion 49 can be formed as a one-piece molded member together with the electrode shaft 46. Yet, in order not to impair its magnetization it possesses a soft iron insert 50. The coil holder 7 is here somewhat modified in that it forms a sleeve 51 having external threading 51*a* and into which sleeve there is inserted the magnet coil 25 which is secured therein, for instance by means of a threaded or screw head 52.

Figure 3:
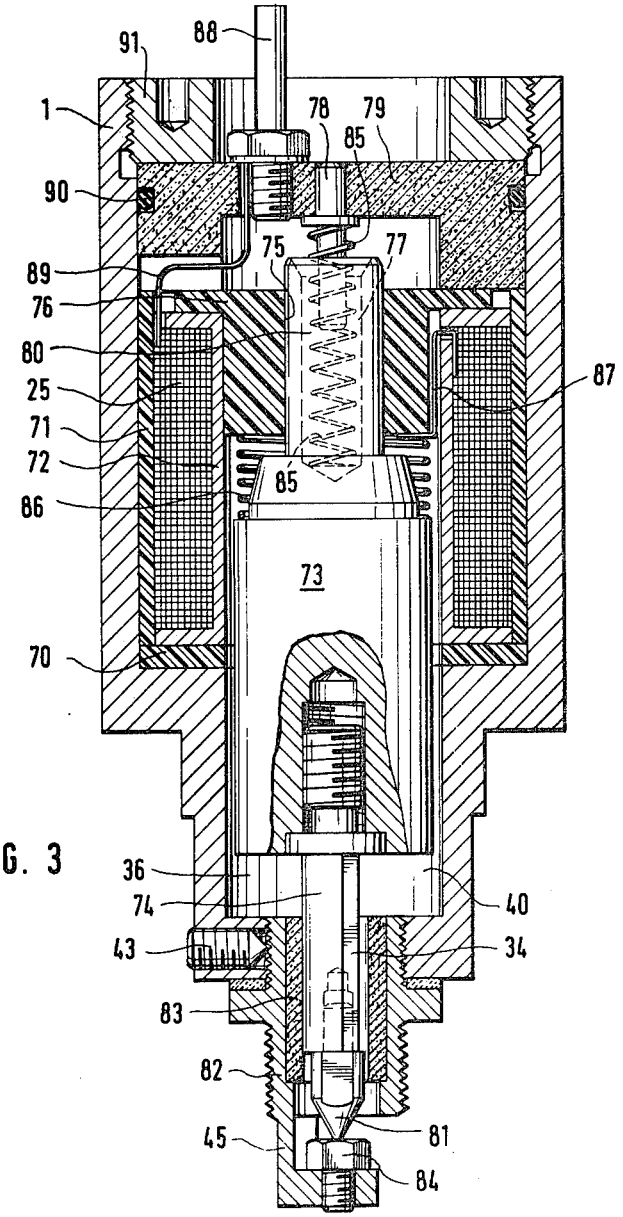
FIG. 3 is a vertical sectional view of still another exemplary embodiment of inventive break ignition plug.

In FIG. 3 there is shown a still further modification of a break ignition plug comprising a housing 1 formed of rustproof, anti-magnetic steel. Within the housing 1 there is mounted a magnet coil 25 which is protected against the thermal effects by a suitable ring or ring member 70 and a bushing 71 formed for instance of a high heat-resistant plastic. A coil core 72 formed of soft iron is arranged at the inner side of the magnet coil 25 and concentrically of the housing 1. Further, an armature 73 with a thereat mounted rustproof guide plunger 74 is provided, armature 73 being here arranged within the coil core 72. An oppositely arranged further plunger 80 extends through a bore 75 of an annular or ring-shaped member 76 formed of a suitable insulating material, such as plastic. Furthermore, plunger 80 has a central hole or bore 76 receiving a bolt 78 which is secured to plate-like member 79 within housing 1.

A tungsten electrode 81 is mounted in the guide plunger 74 and the housing 1 is here also provided with a headpiece 82 including the support bracket 45 and having a ceramic guide sleeve 83. A tungsten electrode 84 is carried by the angled support bracket 45 of the housing headpiece 82. In order to produce the necessary electrode contact force there is provided an inner compression or pressure spring 85 around bolt 78 which extends into bore 77 of plunger 80 and which is formed of an electrically non-conductive material, this pressure or compression spring 85 being a rather powerful spring. An outer pressure or compression spring 86 which conducts current, is connected at its inner end by conductive clip or bracket 87 with the windings of the coil 25. This pressure spring 86 is weaker since it is current-conducting. Further, current-connection bolt 88 or equivalent structure is connected by clip or bracket 89 with the outer end of the windings of the magnet coil 25. Reference characters 90 and 91 denote various seals- and holder elements, respectively.

It will thus be seen that in this arrangement there are provided two pressure or compression springs 85 and 86 instead of one as was the case for the prior discussed embodiments. Furthermore, as will be apparent from the foregoing discussion the coil jacket and the armature mounting is different for this arrangement from those previously disclosed. Whereas with the prior discussed embodiments the armature is located at the side of the electromagnet confronting the internal space of the cylinder, with the arrangement of FIG. 3 the armature 73 protrudes by means of a considerable part thereof into the electromagnet, in other words as partially arranged therein. As already explained, at the upper armature part or portion there is located the guide plunger 80 where there is arranged the one non-current conducting stronger compression spring 85 for producing the necessary electrode contact force. The second outer weaker compression spring 86, as mentioned, is current conducting and electrically connected with the windings of the coil 25 at its inner end. During operation, the current flows from the connection bolt 88, constituting the positive terminal, via the magnet coil 25 to the compression spring 86. From this location the current flows via the armature 73 and the lower guide plunger 74 to the electrode 81 and to the other stationary electrode 84 and then to the housing 1 which constitutes the negative terminal. The generated current pulse energizes the magnet coil 25. The soft iron armature 73 together with the guide plunger 74 and the electrode 81 is retracted upwardly as soon as the magnetic field is more powerful than the pressure exerted by the compression or pressure springs 85 and 86. Hence, the electrode 81 is torn away from the electrode 84, producing the ignition spark.

Having now had the benefit of the foregoing discussion of the exemplary embodiments of break ignition plugs of the invention their mode of operation will be considered with respect to FIG. 3*a* and is as follows: The current which is delivered by a conventional power source, such as an automobile or boat battery 60 is transformed by a voltage transformer 61 to 36 volts and delivered to a contact transmitter, distributor 62 or the like. From the distributor 62 there flow the individual ignition currents to the break ignition plugs, here generally designated by reference character 63, and specifically in the desired sequence. In the individually supplied ignition plugs the current flows through the iron core 22 by means of the compression spring 20 to the armature 17, from the latter through both of the electrodes 14 and 10 (FIG. 1) or 47 and 10 (FIG. 2) and finally through the housing 1 to ground. At the same time there is energized the electromagnet and the armature 17 is attracted. As a result, the movable electrode 14 or 47 is lifted-off or raised from the counter electrode 10. In this way there is produced the desired break ignition spark, which is supplied both from the 36 volt voltage as well as also from the resultant induction voltage. This operation repeats in accordance with the delivery of current through the contact transmitter or the like. As a result, raising of the movable electrode 14 or 47 can be appropriately influenced by the pressure equalization brought about by the compression gases, in the manner previously explained. Due to interruption of the current flow through the electrodes the magnetic field also collapses and the armature returns back into its starting or contact position together with the electrode under the influence of the compression or pressure spring. The mode of operation of the ignition plug of FIG. 3, which is particularly useful for motor boats, has already been previously considered.

In order to increase their longevity the active electrode surfaces are advantageously alloyed with 2 percent by weight thorium. The compression springs can be fabricated from commercially available spring steel wire. Their compressive force, typically that of springs 20, 85 can amount to for instance 0.6 kp. The magnet holder 7 is adjustable in axial direction with the aid of its threading relative to the housing 1. The spark path which gradually increases during operation, and with a new plug amounts to about 1 millimeter, when necessary can be thus again readjusted. Tests have shown that even with a spark path of 4 to 5 millimeters there nonetheless is present a faultless break spark, but such large spark path increases the natural frequency, so that readjustment is advantageous after a certain period of operation.

The invention is not limited to the illustrated exemplary embodiments. Thus, for instance, according to further modifications as contemplated, the spark plugs also can consist of an assembled together housing. The magnet holder could be adjustably connected with the housing by a coupling-threading. Also, the armature of FIGS. 1 and 2 could be constructed without any ring-shaped shoulder if the compression spring bears at its rear surface. In such case the armature can be guided at the housing wall throughout its entire length or height. The bevelled portions of the electrode also can be replaced by longitudinal grooves or by internal bores. Finally, there can be incorporated into the current supply for the spark plugs also thyristors which are controlled by the ignition distributor. As already explained, in all of the embodiments the lower end of the ignition plug, typically the bottom portion thereof, opens into the related internal chamber or compartment of the cylinder of the piston motor or engine, not particularly shown to simplify the illustration.

While there are shown and described present preferred embodiments of the invention, it is to be distinctly understood that the invention is not limited thereto, but may be otherwise variously embodied and practiced within the scope of the following claims. Accordingly,

What I claim is:

1. A break ignition plug for piston motors or the like having a cylinder with an internal compartment comprising:

an electromagnet including a magnet coil;

an armature acted upon by said electromagnet;

a movable electrode actuated by said armature;

a counterelectrode cooperating with said movable electrode and defining therebetween a short-circuit path, said counterelectrode defining a ground electrode;

an ignition pulse flowing through the magnet coil of the electromagnet and the short-circuit path between the movable electrode and the counterelectrode;

the magnetic field which builds-up in the electromagnet causing breaking of the short-circuit path with spark formation;

means defining a pressure equalization chamber capable of communicating with an internal compartment of the cylinder of the piston motor for relieving the forces which are to be applied by the armature for the movement of the movable electrode;

a spring provided for the electromagnet against which there can be attracted the armature;

said armature being dispositioned at least in part at a side of the electromagnet intended to confront the inner compartment of the cylinder of the piston motor;

said armature supporting the movable electrode which extends in the direction of the inner compartment of the cylinder;

said movable electrode having a contact tip;

an ignition plug housing receiving therein the electromagnet and armature;

a bottom portion provided for the ignition plug housing and having means for opening thereof into the inner compartment of the cylinder;

said contact tip of the movable electrode protruding into the bottom portion of the ignition plug housing; and said counterelectrode being fixedly mounted at the ignition plug housing and being arranged in the axial direction with respect to the movable electrode which is movable vertically towards and away therefrom.

2. The break ignition plug as defined in claim 1, wherein:

said ignition plug housing has an armature chamber therein;

said movable electrode possessing at least one peripheral bevelled portion for the formation of a passageway for flow of compression gas from the piston motor to the armature chamber.

3. The break ignition plug as defined in claim 1, wherein:

said contact tip of the movable electrode comprises an exchangeable tip.

4. The break ignition plug as defined in claim 1, further including:

a threaded portion; and screw connection means for connecting the threaded portion with the ignition plug housing.

5. The break ignition plug as defined in claim 1, wherein:

said counterelectrode is exchangeably mounted in said bottom portion.

6. The break ignition plug as defined in claim 1, further including:

a magnet holder having screw connection means and mounting the electromagnet in said ignition plug housing.

7. The break ignition plug as defined in claim 6, wherein:

said ignition plug housing is of substantially cylindrical configuration.

8. The break ignition plug as defined in claim 6, wherein:

said screw connection means is arranged between the magnet holder and the housing and is adjustable in axial direction for adjusting the movable electrode.

9. The break ignition plug as defined in claim 1, wherein:

said armature includes a ring-shaped shoulder;

means for sealing said shoulder with respect to the ignition plug housing.

10. The break ignition plug as defined in claim 2, further including:

means for sealing the magnet coil in relation to the armature chamber in a pressure and gastight fashion.

11. The break ignition plug as defined in claim 10, wherein:

said sealing means comprises at least one seal.

12. The break ignition plug as defined in claim 10, wherein:

said sealing means comprises an asbestos insert.

13. The break ignition plug as defined in claim 1, wherein:

said armature is located completely externally of the electromagnet at the region of said confronting side thereof.

14. The break ignition plug as defined in claim 1, wherein:

said electromagnet has an annular configuration and is provided with a central opening;

said armature having a part thereof extending into said central opening.

15. The break ignition plug as defined in claim 14, wherein:

said armature has a further part thereof located externally of said confronting side of said electromagnet.

16. The break ignition plug as defined in claim 1, wherein:

said electromagnet includes a further side opposite said confronting side;

a spring member bearing against said further side of said electromagnet.

17. The break ignition plug as defined in claim 16, wherein:

said spring member is formed of a current-conducting material.

18. The break ignition plug as defined in claim 16, wherein:

said spring member exerts a smaller force than said spring.

19. A break ignition plug for piston motors or the like, comprising:

an electromagnet including a magnet coil;

an armature acted upon by said electromagnet;

a movable electrode actuated by said armature;

a counterelectrode cooperating with said movable electrode and defining therebetween a short-circuit path, said counterelectrode defining a ground electrode;

an ignition pulse flowing through the magnet coil of the electromagnet and the short-circuit path between the movable electrode and the counterelectrode;

the magnetic field which builds-up in the electromagnet causing breaking of the short-circuit path with spark formation;

a spring provided for the electromagnet against which there can be attracted the armature;

said armature being dispositioned at least in part at one given side of the electromagnet;

said armature supporting the movable electrode;

said movable electrode having a contact tip;

an ignition plug housing receiving therein the electromagnet and armature;

a bottom portion provided for the ignition plug housing;

said contact tip of the movable electrode protruding into the bottom portion of the ignition plug housing; and said counterelectrode being fixedly mounted at the ignition plug housing and being arranged in the axial direction with respect to the movable electrode which is movable vertically towards and away therefrom.

* * * * *